US005673454A

United States Patent [19]

Quintanilla et al.

[11] Patent Number: 5,673,454

[45] Date of Patent: Oct. 7, 1997

[54] THREE-HEAD TOOTHBRUSH

[75] Inventors: Jorge Quintanilla, Leones; Marcos Harari, Av Reforma, both of Mexico

[73] Assignee: Benefit International Products, Ltd., Mexico City, Mexico

[21] Appl. No.: 500,779

[22] Filed: Jul. 11, 1995

[51] Int. Cl.[6] ..... A46B 9/04

[52] U.S. Cl. ..... 15/167.2; 15/111; 132/309; 606/161

[58] Field of Search ..... 15/111, 167.2; 132/309; 606/161

[56] References Cited

U.S. PATENT DOCUMENTS

| | | | |
|---|---|---|---|
| D. 41,285 | 4/1911 | Kress | D4/106 |
| D. 53,715 | 8/1919 | Samson . | |
| 1,110,406 | 9/1914 | Schreck | 15/201 |
| 1,908,509 | 5/1933 | Davis | 15/167.2 |
| 2,093,383 | 9/1937 | Rudolf et al. | 15/167.2 |
| 2,214,407 | 9/1940 | Deutsch . | |
| 2,771,624 | 11/1956 | Ripper | 15/167.1 X |
| 3,022,814 | 2/1962 | Bodine, Jr. . | |
| 3,367,809 | 2/1968 | Soloff . | |
| 3,937,582 | 2/1976 | Del Bon . | |
| 4,137,593 | 2/1979 | Porper | 15/167.2 |
| 4,326,902 | 4/1982 | Peddie . | |
| 4,387,479 | 6/1983 | Kigyos | 15/167.1 |
| 4,449,266 | 5/1984 | Northemann et al. | 15/167.2 |
| 4,536,694 | 8/1985 | McCarty et al. . | |
| 4,701,229 | 10/1987 | Arakawa et al. . | |
| 4,726,481 | 2/1988 | Hagan . | |
| 4,830,239 | 5/1989 | Tackles . | |
| 4,864,676 | 9/1989 | Schaiper | 15/201 |
| 4,869,277 | 9/1989 | Olsen | 15/167.1 |
| 4,876,157 | 10/1989 | Barman . | |
| 4,938,539 | 7/1990 | Barman | 300/21 |
| 5,114,214 | 5/1992 | Barman | 15/167.2 |
| 5,137,039 | 8/1992 | Klinkhammer | 132/308 |
| 5,148,567 | 9/1992 | Daub | 15/22.1 |
| 5,171,066 | 12/1992 | Klinkhammer | 300/21 |
| 5,221,123 | 6/1993 | Klinkhammer | 300/2 |
| 5,224,764 | 7/1993 | Klinkhammer | 300/21 |
| 5,228,466 | 7/1993 | Klinkhammer | 132/308 |
| 5,305,491 | 4/1994 | Hegemann | 15/167.2 |

FOREIGN PATENT DOCUMENTS

| | | | |
|---|---|---|---|
| 104891 | 9/1938 | Australia | 15/167.2 |
| 588348 | 5/1925 | France | 15/167.2 |
| 855253 | 5/1940 | France | 15/167.2 |
| 1075171 | 4/1954 | France | 15/107.2 |
| 2618651 | 2/1989 | France | 15/167.2 |
| 2641680 | 7/1990 | France | 15/167.2 |
| 857128 | 11/1952 | Germany | 15/111 |
| 2192784 | 1/1988 | United Kingdom | 15/167.2 |
| 89-01303 | 2/1989 | WIPO | 15/167.2 |

*Primary Examiner*—Mark Spisich
*Attorney, Agent, or Firm*—Baker & Botts, L.L.P.

[57] ABSTRACT

An apparatus for brushing teeth 20 including a handle 22 attached at an end 26 to a central brush arm 28, a left brush arm 38 and a right brush arm 36 with a cellulose acetate butyrate glue. The central brush arm 28 attached to the left brush arm 38 and the right brush arm 36 with a cellulose acetate butyrate glue such that the brush heads 52, 54, 56 are flexibly positioned relative to each other. The bristles 58 of the three brushes aligned to contact the ends and sides of teeth of varying sizes.

14 Claims, 3 Drawing Sheets

FIG. 1
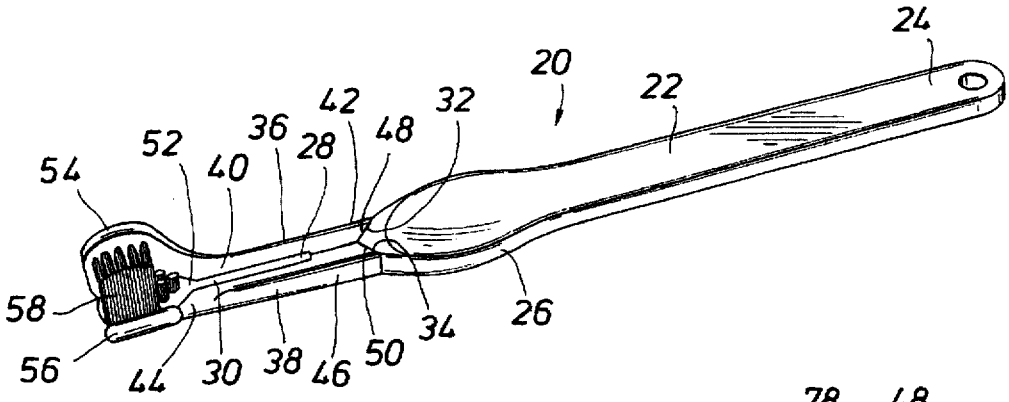
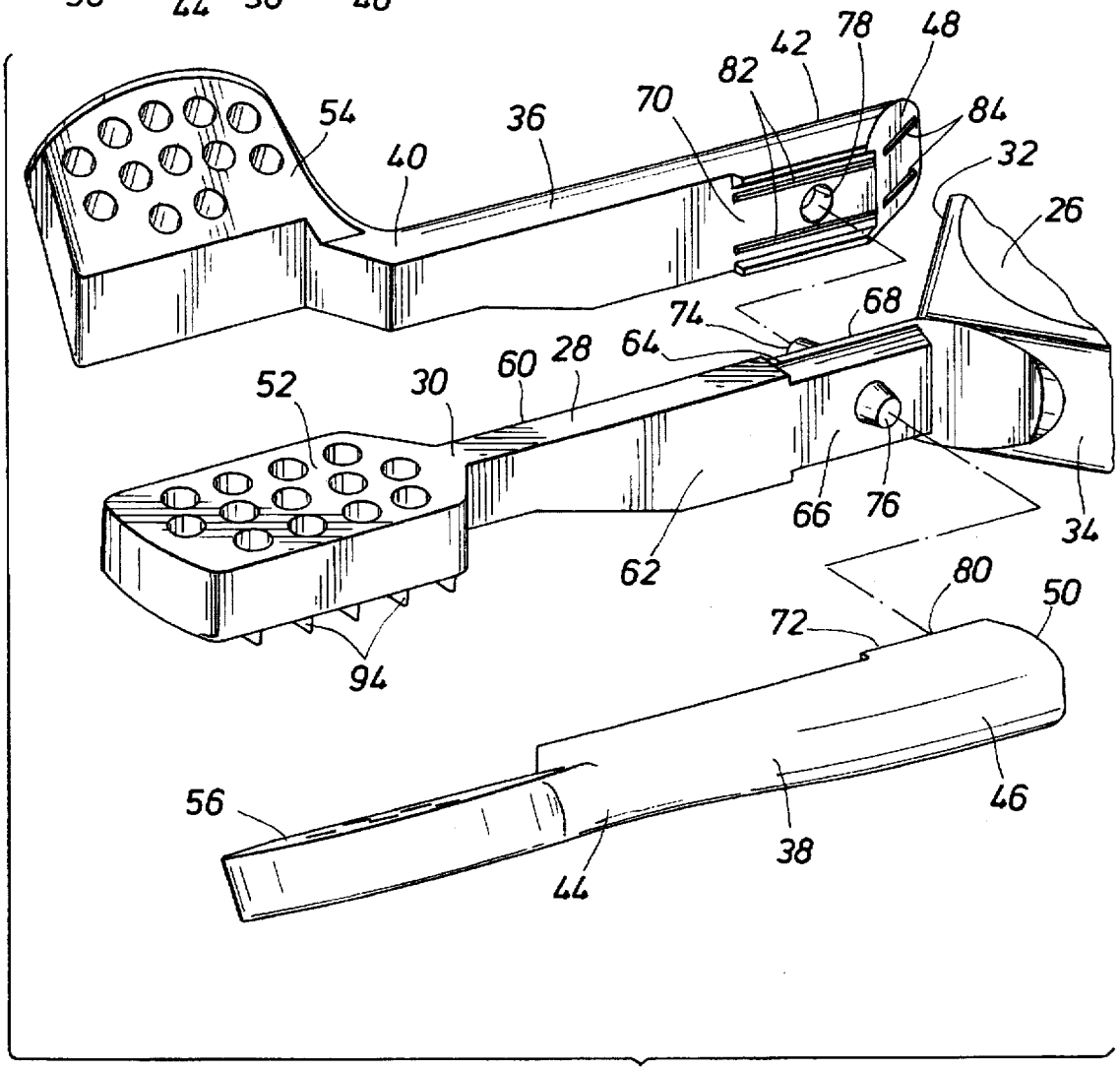
FIG. 2

FIG. 3
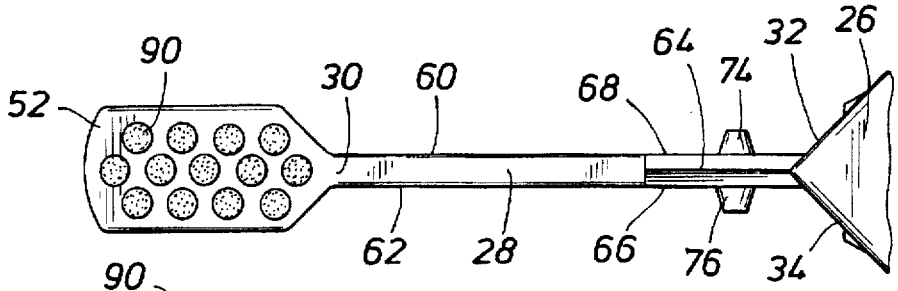
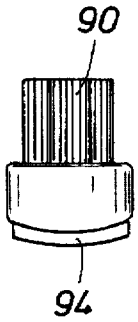
FIG. 5
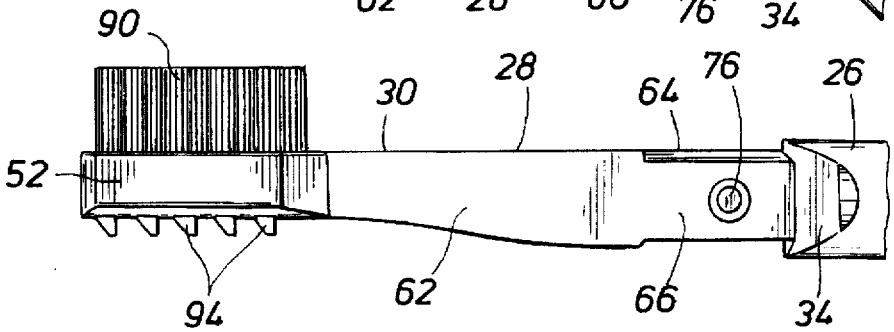
FIG. 4
FIG. 6
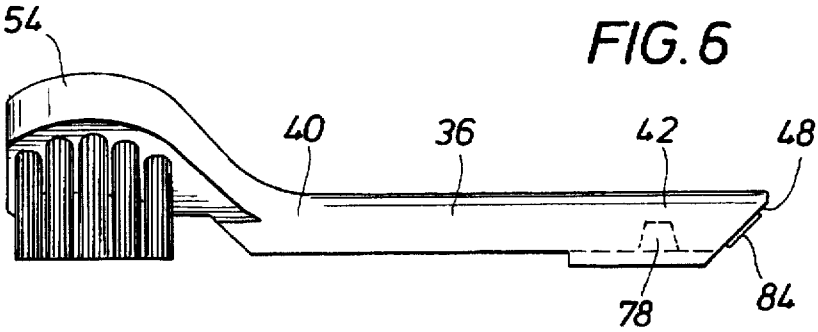
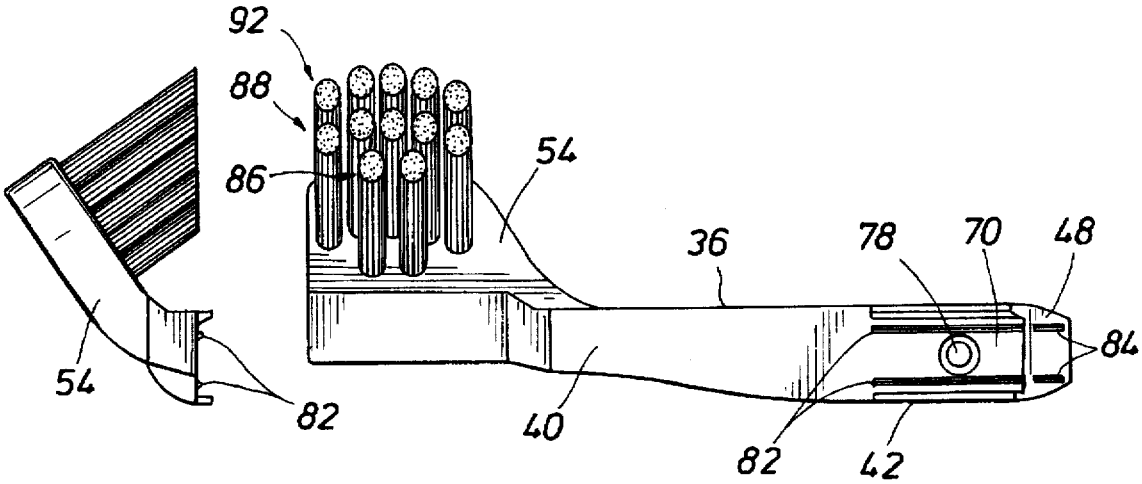
FIG. 8
FIG. 7

FIG. 9
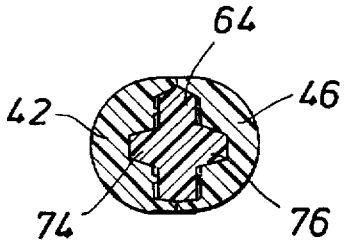
FIG. 10
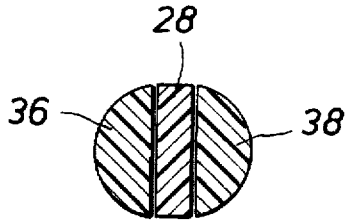
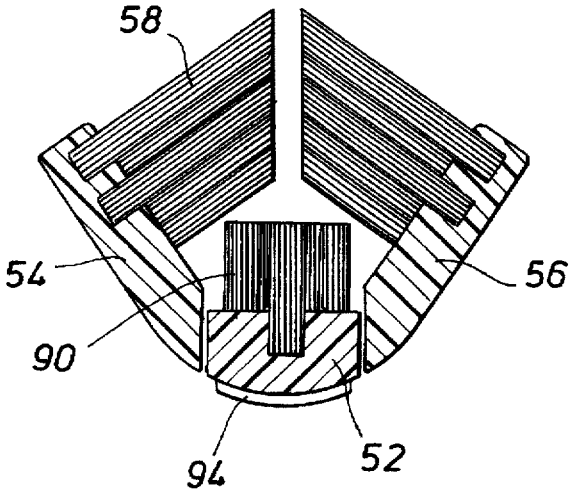
FIG. 11
FIG. 12
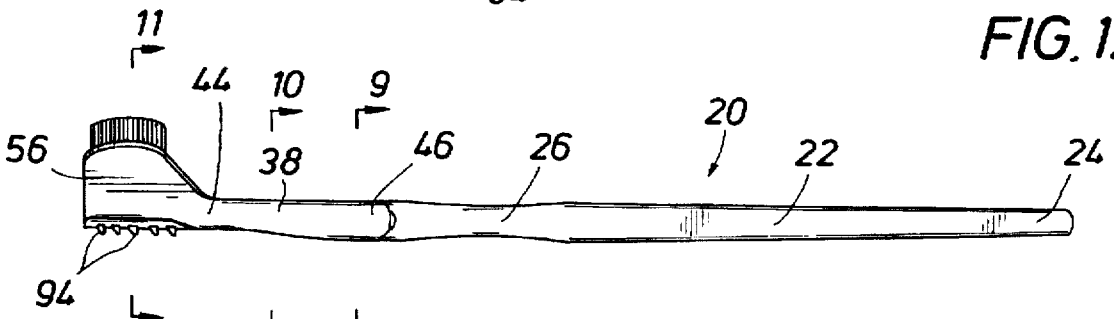
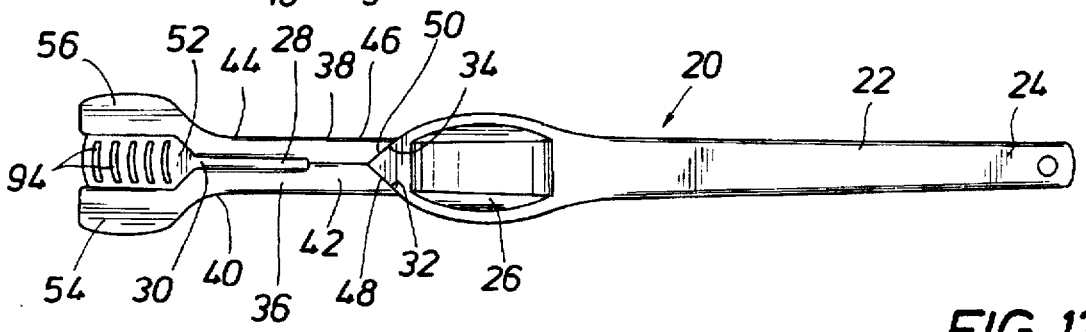
FIG. 13

THREE-HEAD TOOTHBRUSH

FIELD OF THE INVENTION

This invention is related in general to the field of brushes, and more particularly to an apparatus for brushing teeth.

BACKGROUND OF THE INVENTION

A conventional toothbrush has one brush head and is designed to contact only one exposed surface of a tooth at a time. The user must change the alignment of a conventional toothbrush to clean the front and back sides and the top of a tooth. A three-head toothbrush has three independent brush heads and is designed to contact the top and front and back sides of the teeth at the same time. One disadvantage of some three-head toothbrushes is a lack of flexibility or too much flexibility between the side brushes and the center brush. Another disadvantage is bulkiness or presence of protrusions or wires that can cause discomfort in the mouth of a user. A further disadvantage is that they tend to require expensive manufacturing. Another disadvantage is lack of adjustment for teeth of varying arrangements caused by a rigid configuration of the bristles.

U.S. Pat. No. 5,305,491 issued on Apr. 26, 1994 entitled "Self Adjusting Three-Head Toothbrush" discloses a toothbrush that can brush the top and sides of teeth. Many of the disadvantages of some three-head toothbrushes described above were overcome by the invention in the '491 patent. This invention relates to some improvements in the design of the three-head toothbrush described in the '491 patent primarily related to secure attachment of the side brush arms to the handle of the brush. The improved three-head toothbrush of this invention overcomes the disadvantages described above.

SUMMARY OF THE INVENTION

The present invention is an apparatus for brushing teeth (a three-head toothbrush). A preferred embodiment of the invention includes an elongated handle connected to a central arm between a right shoulder and a left shoulder of an end of the handle, a right arm glued to the right shoulder using a cellulose acetate butyrate glue (CABG) and a left arm glued to the left shoulder using CABG. Each arm has a brush head composed of bristles. The bristles of the three brush heads align to contact the top and sides of teeth.

More specifically, the right and left shoulders each forms an obtuse angle with respect to the central arm. Preferably, the right and left shoulders each forms an angle of from 100° to 170° with respect to the central arm. More preferably, the right and left shoulders each form an angle of from 120° to 150° and most preferably of substantially 135° with respect to the central arm. The central arm has mounting areas on its right and left sides that face and are glued to the right and left arms respectively. CABG is preferably used as the glue. Each of the mounting areas includes a primary mating structure which is preferably in the shape of a truncated cone. The right and left arms each has a complementary mating structure, preferably a depression, which is adapted to fit closely with the primary mating structure it faces. The right and left arms include ridges which help the glue to set firmly.

An advantage of the present invention is that the toothbrush can be used vigorously without the danger of disassembly. Another advantage of the present invention is that the three brush heads conform to different configurations of teeth. A further advantage of the present invention is that the toothbrush does not include protrusions or wires that can cause discomfort.

BRIEF DESCRIPTION OF THE DRAWINGS

For a more complete understanding of the present invention and advantages thereof, reference is now made to the following description taken in conjunction with the accompanying drawings in which like reference numbers indicate like features and wherein:

FIG. 1 illustrates a perspective view of an apparatus for brushing teeth constructed according to the present invention.

FIG. 2 illustrates a perspective, exploded view of left, right, and central arms constructed according to the present invention.

FIG. 3 illustrates a top view of the central arm constructed according to the present invention.

FIG. 4 illustrates a side view of the central arm constructed according to the present invention.

FIG. 5 illustrates an end view of the central arm constructed according to the present invention.

FIG. 6 illustrates a top view of the right arm constructed according to the present invention.

FIG. 7 illustrates a side view of the right arm constructed according to the present invention.

FIG. 8 illustrates an end view of the right arm constructed according to the present invention.

FIG. 9 illustrates a cross-sectional view along line 9—9 in FIG. 12.

FIG. 10 illustrates a cross-sectional view along line 10—10 in FIG. 12.

FIG. 11 illustrates a cross-sectional view along line 11—11 in FIG. 12.

FIG. 12 illustrates a side view of the apparatus for brushing teeth constructed according to the present invention.

FIG. 13 illustrates a bottom view of the apparatus for brushing teeth constructed according to the present invention.

DETAILED DESCRIPTION OF THE INVENTION

Referring to FIG. 1, a perspective view of an apparatus for brushing teeth constructed according to the present invention is depicted. The toothbrush 20 has an elongated handle 22 with a base end 24 and a shoulder end 26. A central arm 28 is coupled at a base end 64 (of the central arm) to the shoulder end 26 of the handle 22, dividing the shoulder end 26 into a right shoulder 32 and a left shoulder 34. In the most preferred embodiment, the right and left shoulders 32, 34 each form an angle of substantially 135° with respect to the central arm 28. However, the angle can range from 100° to 170° or more preferably 120° to 150°. The central arm 28 also has a brush end 30 that is coupled to a central brush head 52. A right arm 36 having a base end 42 is glued with CABG, which is commercially available as Eastman® Cement No. 10628 from Eastman Chemical Company of Kingsport, Tenn., to the right shoulder 32 at a first portion 48 of the base end 42. A left arm 38 having a base end 46 is glued with CABG to the left shoulder 34 at a first portion 50 of the base end 46. Eastman® Cement No. 10628 is primarily cellulose acetate butyrate (CAS No. 9004-36-8) and propylene glycol monomethyl ether acetate (CAS No. 108-65-6) along with acetone (CAS No. 67-641) and toluene (CAS No. 108-88-3) as solvents. The central arm 28, right arm 36, left arm 38, and handle 22 are preferably formed of plastic. The plastic from which the structural parts of the toothbrush are molded is preferably a cellulose acetate propionate (CAP) plastic with about 12% plasticizer by weight. If necessary, a mold release agent may be added to the CAP to facilitate removal of the plastic parts from the mold after molding is complete. A preferred CAP plastic is currently sold under the name TENITE® A-371 by Eastman Chemical Company in Kingsport, Tenn. TENITE® A-371 is about 82% cellulose acetate propionate (CAS No. 009004-39-1) and about 17% bis(2-ethylhexyl)adipate (CAS No. 000103-23-1). The left arm 38 and right arm 36 also have brush ends 44 and 40 respectively that are coupled to a left brush head 56 and a right brush head 54, respectively. The brush heads 52, 54, and 56 have tufts of bristles (generally designated as 58 in FIG. 1) and are aligned to direct the bristles 58 into contact with the top surface and sides of teeth.

Referring to FIG. 2, a perspective, exploded view of the left, right, and central arms 38, 36, 28 respectively, constructed according to the present invention is illustrated. A right side 60 of the central arm 28 faces the right shoulder 32. A left side 62 of the central arm 28 faces the left shoulder 34. The right and left sides 60, 62 respectively of the central arm 28 each have a mounting area 68, 66 respectively extending from the base end 64 and terminating before reaching brush end 30. As shown in FIG. 2, mounting areas 68 and 66 mate with corresponding structure on the right and left arms. The size of mounting areas 68 and 66 should be sized from one-tenth to one-half the length of the central arm, preferably one-tenth to one-third the length of the central arm and most preferably from one-tenth to one-quarter the length of the central arm. The length of the central arm 28 for purposes of determining the size of the mounting area is from the shoulder end 26 of handle 22 to the point where central arm 28 joins central brush head 52. Each of the mounting areas 68, 66 is molded to fit a second portion 70, 72 of the corresponding right or left arm 36, 38. The second portions 70, 72 are glued with CABG to the mounting areas 68, 66. A primary mating structure 74, 76 is located within each mounting area 68, 66. Each second portion 70, 72 has ridges 82, (the ridges of the left arm 38 are not shown) and a complementary mating structure 78, 80. The primary mating structures 74, 76 and the complimentary mating structures 78, 80 are adapted to fit closely together. The primary mating structures 74, 76 are preferably in the shape of a truncated cone. The complimentary mating structures 78, 80 are preferably depressions that closely engage the primary mating structures 74, 76. The first portions 48, 50 have ridges 84, (the ridges of the left arm 38 are not shown). The ridges 82, 84 increase the strength of the glue bond. Optionally, central brush head 52 may be molded with tongue cleaning ridges 94.

Referring to FIG. 3, a top view of the central arm 28 constructed according to the present invention is illustrated. The shoulder end 26, the right and left shoulders 32, 34, and the base end 64 and the brush end 30 of the central arm 28 are depicted. The central arm 28 includes mounting areas 68, 66 which include primary mating structures 74, 76 located on the sides 60, 62 of the central arm 28. Bristles 90 are located on the central brush head 52 and may be soft, medium or firm bristles as known in the art.

Referring now to FIG. 4, a side view of the central arm 28 constructed according to the present invention is depicted. Tongue cleaning ridges 94 are located on the bottom of the central brush head 52 which is coupled to the brush end 30 of the central arm 28. The base end 64 of the central arm 28 is coupled to the shoulder end 26 of the handle 22. The left shoulder 34 faces the left side 62 which includes the mounting area 66 and the primary mating structure 76.

Referring now to FIG. 5, an end view of the central arm 28 constructed according to the present invention is depicted. The bristles 90 and tongue cleaning ridges 94 are illustrated.

Referring now to FIG. 6, a top view of the right arm 36 constructed according to the present invention is depicted. The base end 42 of the right arm 36 includes the complementary mating structure 78 and the first portion 48. The ridges 84 are located on the first portion 48. The brush end 40 is coupled to the right brush head 54. The use of the term "coupled" in this specification with respect to joining of the brush heads to the arms does not necessarily mean that two separately molded parts have been joined together. Preferably, the arms and brush heads are integrally molded in one overall piece that has two portions, an arm portion and a brush head portion.

Referring now to FIG. 7, a side view of the right arm 36 constructed according to the present invention is depicted. The base end 42 of the right arm 36 includes the first portion 48 and the second portion 70. The ridges 84 are located on the first portion 48. The complementary mating structure 78 and the ridges 82 are located on the second portion 70. The brush end 40 is coupled to the right brush head 54 which includes a first row of bristles 86, a second row of bristles 88, and a third row of bristles 92. In the preferred embodiment, the bristles 90 and the bristles in the first row of bristles 86 of the right brush head 54 have substantially the same diameter. The bristles 90 and the bristles in the first row 86 are preferably firm bristles. The bristles in the second and third rows of bristles 88, 92 are preferably of a diameter less than the diameter of the bristles 90 located on the central head 52 and may be soft, medium or firm bristles, preferably soft bristles. The left brush head 56 also has first, second, and third rows of bristles (not shown) which correspond to those on the right brush head 54.

Referring now to FIG. 8, an end view of the right arm 36 constructed according to the present invention is depicted. The ridges 82 and right brush head 54 are illustrated.

Referring now to FIG. 9 a cross-sectional view along line 9—9 in FIG. 12 is depicted. The primary mating structures 74, 76 of the base end 64 of the central arm 28 (see FIG. 2) engage the complementary mating structures 78, 80 (see FIG. 2) of the base ends 42, 46 of the right and left arms 36, 38 (see FIG. 2).

Referring now to FIG. 10 a cross-sectional view along line 10—10 in FIG. 12 is depicted. The central arm 28 is between the right and left arms 36, 38.

Referring now to FIG. 11 a cross-sectional view along line 11—11 in FIG. 12 is depicted. The central brush head 52 has bristles 90 and ridges 94. The right and left brush heads 54, 56 have bristles 58 and are located adjacent the central brush head 52.

Referring now to FIG. 12 a side view of the toothbrush 20 constructed according to the present invention is depicted. The elongated handle 22 includes the base end 24 and the shoulder end 26 which is glued using CABG to the base end 46 of the left arm 38. The brush end 44 is coupled to the left brush head 56. The tongue cleaning ridges 94 are also illustrated.

Referring now to FIG. 13 a bottom view of the toothbrush 20 constructed according to the present invention is illustrated. The elongated handle 22 includes the base end 24 and the shoulder end 26 which is divided by the central arm 28 into right and left shoulders 32, 34. The right and left shoulders 32, 34 are glued using CABG to the first portions 48, 50 of the base ends 42, 46 of the right and left arms 36, 38, respectively. The brush ends 40, 44 of the right and left arms 36, 38 are coupled to the right and left brush heads 54, 56, respectively. The brush end 30 of the central arm 28 is coupled to the central brush head 52 which has tongue cleaning ridges 94.

The parts of the toothbrush may be molded separately and joined together. Tufts of bristles can be installed in the brush heads after molding by machines and processes well known in the art of making toothbrushes. Machines and methods for bristling are also described in U.S. Pat. No. 5,305,491. The various parts of the toothbrush may be molded at the same time in one multi-cavity mold having cavities for each of (a) the right brush head and right arm, (b) the left brush head and the left arm, and (c) the central brush head, central arm and handle. Mold cavities should be shaped to conform to desired shape of the parts of the toothbrush as is well-known in the molding art. As is standard in gluing operations, the surfaces to be glued should be kept clean to allow a strong bond between the glue and the surface.

In operation, the toothbrush 20 is grasped by the handle 22 and brought to the mouth. The central, right and left brush heads 52, 54, 56 are placed around the teeth and the apparatus 20 is moved along a row of teeth such that the firm bristles 86, 90 contact the enamel surfaces of the teeth and the softer bristles each with a smaller diameter 88, 92 contact the sulcus and gums. Preferably, toothpaste is used during the initial stages of such movement. The right and left arms 36, 38 are flexible enough to adapt to the size of the teeth while the CABG and the primary and complementary mating structures combine to keep the arms 36, 38 firmly attached to both the central arm 28 and the shoulders 32, 34 of the handle 22. Thus, the toothbrush 20 can be used vigorously without the danger of disassembly, while the three brush heads conform to different configurations of teeth. Another advantage is that the toothbrush 20 does not include protrusions or wires that can cause the mouth discomfort.

Although the present invention has been described in detail, it should be understood that various changes, substitutions and alterations can be made without departing from the spirit and scope of the invention as defined by the appended claims.

What is claimed is:

1. An apparatus for brushing teeth comprising:

(a) an elongated handle having a base end and a shoulder end;

(b) a central arm having a brush end and a base end wherein said base end is integral with said elongated handle at said shoulder end and wherein said central arm divides said shoulder end of said elongated handle into a right shoulder and a left shoulder;

(c) a right arm and a left arm each having a brush end and a base end wherein a first portion of said base end of said right arm is glued to said right shoulder and a first portion of said base end of said left arm is glued to said left shoulder;

(d) a central brush head integral with said brush end of said central arm; and (e) a right brush head integral with said brush end of said right arm and a left brush head integral with said brush end of said left arm;

wherein said central brush head, said right brush head and said left brush head each comprises tufts of bristles and are aligned to direct said bristles into contact with the top surface and two side surfaces of teeth;

wherein said central arm has a right side facing said right shoulder and a left side facing said left shoulder and has mounting areas on each of said right side and said left side extending from said base end and terminating before reaching said brush end;

wherein a second portion of said base end of said right arm is glued to said mounting area on said right side of said central arm and a second portion of said base end of said left arm is glued to said mounting area on said left side of said central arm;

wherein said mounting areas on said central arm each comprises a primary mating structure and wherein said second portions of said base ends of said right arm and said left arm each comprises a complimentary mating structure, said primary mating structures and said complimentary mating structures are adapted to fit closely together; and wherein said primary mating structures are each in the shape of a truncated cone and said complimentary mating structures are each a depression.

2. An apparatus in accordance with claim 1 wherein said second portions of said base ends of said right arm and said left arm each further comprises a plurality of ridges.

3. An apparatus in accordance with claim 1 wherein said first portions of said base ends of said right arm and said left arm each comprises a plurality of ridges.

4. An apparatus in accordance with claim 1 wherein said central brush head, said right brush head and said left brush head each have rows of tufts of bristles, said right brush head and said left brush head each have a first row of tufts of bristles closest to the central brush head wherein the tufts of bristles in the central brush head and the tufts of bristles in said first row of tufts of bristles all comprise bristles of the same diameter.

5. An apparatus in accordance with claim 4 wherein said bristles in said central brush head and in said first row of tufts if bristles are firm bristles.

6. An apparatus in accordance with claim 5 wherein both the right brush head and the left brush head have a second row of tufts of bristles and a third row of tufts of bristles and the bristles in each of said second row and said third row have diameters less than the diameters of bristles in said central brush head.

7. An apparatus in accordance with claim 6 wherein a cellulose acetate butyrate glue is used to glue said right arm to both said right shoulder and said central arm and wherein a cellulose acetate butyrate glue is used to glue said left arm to both said left shoulder and said central arm.

8. An apparatus for brushing teeth comprising:

(a) an elongated handle having a base end and a shoulder end;

(b) a central arm having a brush end and a base end wherein said base end is integral with said elongated handle at said shoulder end; wherein said central arm divides said shoulder end of said elongated handle into a right shoulder and a left shoulder; and wherein said right shoulder and said left shoulder each forms an obtuse angle with respect to the central arm;

(c) a right arm and a left arm each having a brush end and a base end wherein a first portion of said base end of said right arm is glued to said right shoulder and a first portion of said base end of said left arm is glued to said left shoulder;

(d) a central brush head integral with said brush end of said central arm; and (e) a right brush head integral with said brush end of said right arm and a left brush head integral with said brush end of said left arm;

wherein said central brush head, said right brush head and said left brush head each comprises tufts of bristles and are aligned to direct said bristles into contact with the top surface and two side surfaces of teeth.

9. An apparatus in accordance with claim 8 wherein said central arm has a right side facing said right shoulder and a left side facing said left shoulder and has mounting areas on each of said right side and said left side extending from said base end and terminating before reaching said brush end, wherein a second portion of said base end of said right arm is glued to said mounting area on said right side of said central arm and a second portion of said base end of said left arm is glued to said mounting area on said left side of said central arm.

10. An apparatus in accordance with claim 9 wherein said mounting areas on said central arm each comprises a primary mating structure and wherein said second portions of said base ends of said right arm and said left arm each comprises a complimentary mating structure, said primary mating structures and said complimentary mating structures are adapted to fit closely together.

11. An apparatus in accordance with claim 10 wherein said primary mating structures are each in the shape of a truncated cone, and said complimentary mating structures are each a depression in said right arm and said left arm.

12. An apparatus in accordance with claim 11 wherein said first portions of said base ends of said right arm and said left arm each comprises a first ridge and a second ridge.

13. An apparatus in accordance with claim 11 wherein said second portions of said base ends of said right arm and said left arm each further comprises a first ridge and a second ridge.

14. An apparatus in accordance with claim 9 wherein a cellulose acetate butyrate glue is used to glue said right arm to both said right shoulder and said central arm and wherein a cellulose acetate butyrate glue is used to glue said left arm to both said left shoulder and said central arm.

* * * * *